US008404419B2

(12) United States Patent
Konno et al.

(10) Patent No.: US 8,404,419 B2
(45) Date of Patent: Mar. 26, 2013

(54) ELECTROSTATIC IMAGE DEVELOPING TONER

(75) Inventors: Hiroyuki Konno, Tokyo (JP); Kazuhiko Nakajima, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 196 days.

(21) Appl. No.: 13/096,217

(22) Filed: Apr. 28, 2011

(65) Prior Publication Data

US 2011/0281211 A1 Nov. 17, 2011

(30) Foreign Application Priority Data

May 12, 2010 (JP) ..... 2010-109833

(51) Int. Cl.
*G03G 9/087* (2006.01)

(52) U.S. Cl. ..... 430/109.1; 430/109.3; 430/109.4

(58) Field of Classification Search ..... 430/109.1, 430/109.3, 109.4
See application file for complete search history.

(56) References Cited

U.S. PATENT DOCUMENTS 5,496,676 A * 3/1996 Croucher et al. ..... 430/137.14
5,585,215 A * 12/1996 Ong et al. ..... 430/108.2

FOREIGN PATENT DOCUMENTS

| | | |
|---|---|---|
| JP | 03-217849 | 9/1991 |
| JP | 07-181740 | 7/1995 |
| JP | 08-305079 | 11/1996 |

* cited by examiner

*Primary Examiner* — Hoa V Le
(74) *Attorney, Agent, or Firm* — Lucas & Mercanti, LLP

(57) ABSTRACT

Provided is an electrostatic image developing toner containing, (i) toner particles containing: a binder resin having a domain-matrix structure; and (ii) a colorant; wherein the toner particles have a volume-based median diameter of 4.3 to 7.0 μm; a domain phase in the binder resin contains a polymer containing a structure unit derived from a diene monomer, the domain phase has a Feret diameter of 50 to 300 nm; and a glass transition temperature of the polymer composing the domain phase is −85 to +35° C.

15 Claims, No Drawings

ELECTROSTATIC IMAGE DEVELOPING TONER

CROSS-REFERENCE TO RELATED APPLICATION

This application is based on Japanese Patent Application No. 2010-109833 filed on May 12, 2010 with Japan Patent Office, the entire content of which is hereby incorporated by reference.

TECHNICAL FIELD

The present invention relates to an electrostatic image developing toner used for an image formation with an electrophotographic method (hereafter, it is also called simply as "a toner").

BACKGROUND

In recent years, the way of saving energy is investigated in various fields in view of preventing global warming. Progress has been made in the information apparatus such as an image forming apparatus which can be operated with low energy by introduction of energy saving during stand-by time of the apparatus, and at the same time, it has been investigated the way of lowering fixing temperature in the fixing process which consumes most energy.

Generally speaking, when a toner is designed to have an ability of corresponding to low-temperature fixation, it will become inferior in blocking resistance or heat-resistant storage property. However, in order to make compatible both low-temperature fixability and blocking resistance, there is disclosed as a toner for electrophotographic image formation, in which an ABA type block copolymer consisting of styrene acrylic copolymer blocks is employed as a binder resin, for example refer to Patent document 1. It is supposed that when such toner is used in a fixing process, the affinity of a block copolymer and an image carrier will be increased during heat melting step of the toner on the image carrier, such as paper, and that compatibility of low-temperature fixability and blocking resistance will be improved.

However, since there was a limitation for the lowest glass transition temperature of a block copolymer from the viewpoint of heat-resistant storage property, it was still not enough to achieve sufficient improvement in low-temperature fixability was enough.

Moreover, in Patent document 2, there is disclosed a suspension polymerization toner containing a binder resin composed of a styrene-acrylic resin as a main resin to which is added a styrene-diene block co-polymer as a technique of making compatible of low-temperature fixability, heat-resistant storage property and blocking resistance. By using such toner, it is possible to apply the effect of encapsulating a wax in the styrene diene block copolymer during the particle producing process. And it is supposed that blocking resistance can be improved without raising fixing temperature.

However, since the styrene diene block copolymer is not distributed homogeneously in the main resin, there is problem that a hot offset phenomenon occurs. Moreover, there is another problem that fold fixability is low. Namely, the obtained fixed image becomes weak, and when this fixed image is folded, the fixed image at the folded portion will be broken and it will be peeled off.

On the other hand, it is proposed a core-shell structure toner as a technique to improve compatibility of low-temperature fixability and heat-resistant storage properties of the toner, and although low-temperature fixability is acquired to some extent after heat-resistant storage property is secured by using such toner, there is a problem that fold fixability is still low.

Moreover, there is disclosed a toner using the rubber-like substance obtained by cross-linking a binder resin with a crude rubber as a technique of achieving compatibility of low-temperature fixability and blocking resistance in Patent document 3. However, sufficient low-temperature fixability was not acquired in the toner having a small particle size.

Patent document 1: Japanese Patent Application Publication (it is called as JP-A) No. 3-217849

Patent document 2: JP-A No. 7-181740

Patent document 3: JP-A No. 8-305079

SUMMARY

The present invention was made in consideration of the above-described situations. An object of the present invention is to provide a toner which enable to form a high quality image with achieving low-temperature fixability, high heat-resistant storage property and high blocking resistance, and moreover, achieving excellent hot off-set resistant property and high fold fixability.

The toner of the present invention has the following features:

it comprises toner particles containing: (i) a binder resin having a domain-matrix structure; and (ii) a colorant;

the aforesaid toner particles have a volume-based median diameter of 4.3 to 7.0 μm;

the domain phase in the aforesaid binder resin comprises a polymer containing a structure unit derived from a diene monomer.

the domain phase has a Feret diameter of 50 to 300 nm; and the glass transition temperature of the polymer composing in the aforesaid domain phase is 85 to +35° C.

In the toner of the present invention, it is preferable that the polymer which composes the aforesaid domain phase contains a structure unit derived from an acidic monomer.

According to the toner of the present invention, it is possible to achieve a high quality image since the size of the toner particles is basically within the specific range. And, at the same time, it is possible to achieve low-temperature fixability with high heat-resistant storage property and high blocking resistance, since the binder resin has a domain-matrix structure in which a domain phase made of the specific polymer is dispersed in matrix phase. Moreover, it is possible to achieve excellent hot off-set resistant property and high fold fixability.

The reason of achieving low-temperature fixability by the toner of the present invention is considered as follows.

The binder resin has a structure in which a polymer having a structure unit derived a diene monomer is introduced as a domain phase in a matrix made of the resin. That is, the binder resin has a structure in which a rubber component is non-compatibly introduced in the form of particles into the resin matrix. It is considered that strength and a stress relaxation characteristic are given to the binder resin, and it is considered that, as a result, the formed image will have high fastness. And by carrying out fine dispersion of the domain phase in the magnitude of the specific range, the contact area of the domain phase with the matrix phase becomes large. As a result, the elasticity by the rubber component is demonstrated effectively. It is thought that this enables the toner to achieve an excellent hot off-set resistant property and fold fixability of the toner.

DESCRIPTION OF THE PREFERRED EMBODIMENTS

Hereafter, the present invention will be described in details.

[Toner]

The toner of the present invention toner particles containing: a binder resin having a domain-matrix structure; and a colorant. In the present invention, In the present invention, "a domain-matrix structure" means a structure where a domain phase having a closed interface (a boundary area of one phase and the other phase) exists in the continuous matrix phase. In addition, the toner particles containing the binder resin having the domain-matrix structure can be checked by observing the toner particle section which carried out osmium staining using a transmission electron microscope (TEM). When cutting down the cut piece of the toner particles using a microtome, the thickness of the cut piece is set as 100 nm.

The toner particles composing the toner of the present invention have a volume-based median diameter of 4.3 to 7.0 μm, and more preferably, it is 4.3 to 6.8 μm. By making the volume-based median diameter of the toner particles in the above-described range, it is possible to form an image of high quality. When the volume-based median diameter of the toner particles is less than 4.3 μm, the formed image will become rough and there is a possibility of deteriorating the low-temperature fixability of the toner. On the other hand. When the volume-based median diameter of the toner particles exceeds 7.0 μm, there is a possibility that the resolution of the formed image and the homogeneity of halftone will be insufficient.

The volume-based median particle diameter of the toner is measured and calculated using a device constituted of "Coulter Multisizer III" (produced by Beckman Coulter, Inc.) and a data processing computer system "Software V. 3.51" (produced by Beckman Coulter, Inc.) connected thereto.

Specifically, 0.02 g of the toner is added in 20 ml of a surfactant solution (being a surfactant solution prepared, for example, via ten-fold dilution of a neutral detergent containing a surfactant component with purified water to disperse a toner), followed by being wetted and then subjected to ultrasonic dispersion for 1 minute to prepare a toner dispersion. The toner dispersion is injected into a beaker, containing electrolyte solution "ISOTON II" (produced by Beckman Coulter, Inc.), set on the sample stand, using a pipette until the concentration indicated by the measuring apparatus reaches 8%. Herein, this concentration value makes it possible to obtain highly reproducible measurement values. Using the measuring apparatus, under conditions of a measured particle count number of 25,000 and an aperture diameter of 50 μm, the frequency is calculated by dividing a measurement range of 1 to 30 μm into 256 parts, and the particle diameter at a 50% point from the higher side of the volume accumulation ratio (namely the volume $D_{50}$% diameter) is designated as the volume-based median diameter.

The toner particles of the present invention preferably exhibit an average circularity of 0.930 to 1.000, more preferably, from 0.950 to 0.995 from the viewpoint of enhancing transfer efficiency.

The average circularity of toner particles can be measured by "FPIA-2100" (manufactured by Sysmex Corp.). Specifically, the toner is wetted with an aqueous solution containing a surfactant, followed by being dispersed via an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated according to Equation (T) described below. Then, the average circularity is calculated by summing the circularities of each of the toner particles and dividing the resulting value by the total number of the toner particles.

Average circularity=(circumference length of a circle having an area equivalent to a projection of a particle)/(circumference length of a projection of a particle) Equation (T)

The glass transition temperature of the toner of the present invention is preferably in the range of 20 to 62° C., more preferably it is from 30 to 50° C., from the viewpoint of realizing both high heat-resistant storage property and high blocking resistance. When the glass transition temperature of the toner is too low, the toner may not have a sufficient degree of blocking resistance and there is a possibility to easily generate aggregation of the toner particles at the time of storage. On the other hand, when the glass transition temperature of the toner is too high, there is a possibility that the toner is hardly melted and it may not have low-temperature fixability.

Herein, the glass transition temperature (Tg) of the toner can be determined using differential scanning calorimeter "DSC 8500" (produced by Perkin Elmer, Inc.). Specifically, about 4.5 mg of the toner is precisely measured to two decimal point, and it is sealed in an aluminum pan and placed in a DSC-7 sample holder. An empty aluminum pan is used as the reference measurement. Subsequently, heating-cooling-heating temperature control is carried out over a measurement temperature range of 0 to 200° C. under measurement conditions of a temperature increasing rate of 10° C./min and a temperature decreasing rate of 10° C. min. Measured data is obtained during the second heating stage, and then a glass transition temperature (Tg) is obtained as a value which is read at the intersection of the extension of the base line, prior to the initial rise of the first endothermic peak, with the tangent showing the maximum inclination between the initial rise of the first endothermic peak and the peak summit.

The softening point of the toner of the present invention is preferably from 80 to 110° C., and it is more preferably from 90 to 105° C. When the softening point of the toner is too low, there is a possibility that hot off-set phenomenon may occur in the fixing process. On the other hand, when the softening point of the toner is too high, there is a possibility that the formed image may not have a sufficient fixing strength.

The softening point of the toner can be specifically measured as follows. Under the atmosphere of 20° C., and 50% RH, 1.1 g of the toner is placed in a laboratory dish and make it flat. After the toner sample is left still for more than 12 hours, it is pressed with a pressure of 3,820 kg/cm$^2$ for 30 seconds using a mold apparatus "SSP-10A" (made by Shimazu Corporation) to produce a mold sample of a round column having a diameter of 1 cm. A flow tester "CFT-500D" (made by Shimazu Corporation) is used at the atmosphere of 24° C. and 50% RH, under the condition of load weight of 196 N (20 kgf); initiation temperature 60° C.; preheating time of 300 seconds; and temperature increasing rate of 6° C./min. After termination of the pre-heating, the mold sample is pressed out though a hole of a round column die (diameter of 1 mm; and length of 1 mm) with a piston having a diameter of 1 cm. The off-set temperature $T_{off\text{-}set}$ measured with a melt temperature measuring method of the temperature increasing mode by setting the off-set value of 5 mm can be determined as a softening point of the toner.

[Binder Resin]

The binder resin having a domain-matrix structure contained in the toner particles constituting the toner of the present invention is in the condition in which a domain phase made of a specific polymer is dispersed in the form of particles into a matrix phase made of a resin (hereafter, it is called as "a matrix resin").

(Domain Phase)

The domain phase in the binder resin having a domain-matrix structure is composed of a specific polymer having a structure unit derived from a diene monomer (hereafter, this specific polymer is also called as "a domain resin".) The domain phase is composed of a polymer having a structure unit derived a diene monomer, namely, it is composed of a rubber component. This domain phase is supposed to produce the following effects in the toner particles.

As a polymer containing the structure unit derived from a diene monomer, it can be cited a copolymer or a homopolymer obtained from conjugated diene monomers. Examples of a conjugated diene monomer include: butadiene, isoprene, 2-chloro-1,3-butadiene, and 2-methyl-1,3-butadiene. Among these, butadiene is especially preferable from the viewpoint of securing fixing strength.

Specific examples of the domain resin include: styrene-butadiene rubber (SBR), nitrile rubber (NR), butadiene rubber (BR), and polyisoprene rubber (IR). Among these, styrene-butadiene rubber (SBR) is especially preferable. In this case, the copolymerization ratio of styrene to butadiene is preferably from 30:70 to 50:50.

The magnitude of the domain phase is usually from 50 to 300 nm with a Feret diameter, and more preferably, it is from 75 to 250 nm.

By making the magnitude of the domain phase in the above-mentioned range, a sufficient contact area of the domain phase with the matrix phase can be obtained. As a result, the elasticity of the domain resin made of the rubber component is demonstrated effectively. It is thought that this enables to provide the toner with an excellent hot off-set resistant property and fold fixability.

When the magnitude of the domain phase in less than 50 nm in Feret diameter, the elasticity of the domain resin made of the rubber component is not effectively demonstrated, and the toner will not have excellent fold fixability. When the magnitude of the domain phase is larger than 300 nm in Feret diameter, the toner will not have excellent blocking resistant property.

The magnitude of the domain phase can be controlled by the size of the resin particles which constitute the domain. Further, it can be controlled by the amount of an acidic monomer structural unit incorporated in the resin constituting the domain. Especially, when the acidic monomer contains a carboxylic acid group, the magnitude of the domain phase in Feret diameter can be small by the effect of the pH value during the preparation of toner particles, and further, the domain phase can be uniformly dispersed in the matrix. Therefore, the acidic monomer containing a carboxylic acid group is preferable.

In the present invention, the magnitude of the domain phase can be determined as follows. Specifically, a thin leaf sample of toner particle is prepared, and a photograph with 10,000 times of magnification of the cross-section of this thin leaf sample is taken using a transmission electron microscope. Feret diameter in a horizontal direction for 100 domain phases is respectively measured. The arithmetic average value thereof is used as the magnitude of the domain phase.

Moreover, the variation coefficient of the particle size distribution in the Feret diameter of domain phases is preferably 20% or less. When the variation coefficient of is 20% or less, the toner has low-temperature fixability while having high heat-resistant storage property and, further, the toner has excellent fold fixability even in the case of only a small amount of domain resin is added.

In addition, a variation coefficient is an index which shows relative dispersion of the Feret diameter of domain phases, and it is calculated by the following formula (CV).

$$\text{Variation coefficient}(\%)=(S2/K2)\times 100 \qquad \text{Formula (CV)}$$

In Formula (CV), S2 is a standard deviation of a Feret diameter in a horizontal direction of 100 domain phases; and K2 is an arithmetic average value of a Feret diameter in a horizontal direction for 100 domain phases.

The glass transition temperature of the domain resin is usually in the range of −85 to +35° C., and more preferably, it is −40 to +30° C.

By making the glass transition temperature of the domain resin in the above-mentioned range, the toner will have excellent fold fixability. In particular, when the glass transition temperature of the domain resin is in the range of −40 to +30° C., the transfer property of the toner is excellent, and further, the granularity in the half tone image will have a tendency to be good.

When the glass transition temperature of the domain resin is less than −85° C., the toner will not have a sufficient amount of blocking resistance, and the toner will not have high heat-resistant storage property. On the other hand, when the glass transition temperature of the domain resin exceeds +35° C., the toner will not have a sufficient amount of low-temperature fixability.

The glass transition temperature of the domain resin can be determined by using a local thermal analysis system employing a thermal probe provided with a heating function on the tip of the probe. Specifically, it is measured using a local thermal analysis system "Nano thermal analysis system (Nano-TA)" (made by Japan Thermal Consulting Co. Ltd.) using a test sample cooled with a liquid nitrogen gas. Namely, a thermal probe is contacted to a measuring region (a portion corresponding to a domain phase) of the test sample prepared by cutting smoothly, and the temperature of the thermal probe is increased. The temperature point at which the deflection voltage corresponding to a penetration depth changed from increase to decrease was determined as a glass transition temperature.

As a domain resin, it is preferable that the content ratio of toluene insoluble components is from 15 to 95 mass %, and more preferably, it is from 30 to 70 mass %.

By making the content ratio of toluene insoluble components in the above-described range, the toner will not prevent low-temperature fixability and the toner will have high hot off-set resistance and high fold fixability.

The toluene insoluble components can be measured as follows. A predetermined amount of test sample is immersed in toluene for 20 hours, then the toluene solution is filtered using a metal net having 120 mesh. It can be calculated as a mass % of the obtained residual solid portion to the weight of the test sample.

As domain resin, it is preferable that it contains a structure unit derived from an acidic monomer. "A domain resin containing a structure unit derived from an acidic monomer" indicates, specifically, a compound as follows. It is a resin introduced an acidic monomer as a polymerizable monomer which forms a domain resin constituting a domain phase. As a dissociation group, a carboxylic group is preferable from the viewpoint of production stability. By making such composition, the domain resin will be homogeneously distributed in the matrix resin and the particle size distribution of the domain phases becomes sharp. As a result, the reforming effect of the toner obtained becomes high. Further, the affinity of styrene acrylic resin and polyester resin, which are suitably used as a matrix resin, with the domain resin is increased. By this improved affinity, the formed image has higher fixing strength.

Specific examples of an acidic monomer include: an unsaturated single valent carboxylic acid such as (metha)acrylic acid; and an unsaturated multi-valent carboxylic acid such as maleic acid, fumaric acid, itaconic acid, citraconic acid, glutaconic acid, tetrahydro phthalic acid, aconitic acid, maleic anhydride, itaconic anhydride, glutaconic anhydride, citraconic anhydride, aconitic anhydride, norbornane dicarboxylic anhydride, and tetrahydrophthalic anhydride. These may be used singly or may be used in combination of tow or more sorts. Especially preferable acidic monomers are acrylic acid and methacrylic acid.

Here, as a way of introducing a structural unit derived from an acidic monomer into a domain resin, although a method of carrying out copolymerization of a diene monomer and an acidic monomer is preferable, it is also possible to use a method in which after carrying out copolymerization of acrylic acid alkyl ester, such as butyl acrylate, for example with a diene monomer to obtain a copolymer, the obtained copolymer is hydrolyzed with hydrochloric acid to convert into acrylic acid.

In addition, as for the copolymerization ratio of an acidic monomer, it is preferable that it is 1 to 5 mass %, for example. By making the copolymerization ratio of an acidic monomer in the above-described range, it is possible to control the aggregation between the particles of the domain resin which is a rubber component.

From the viewpoint of acquiring sufficient fixable possibility temperature range and sufficient fold fixability, a mass average molecular weight (Mw) of the toluene soluble component of the domain resin is usually set to 20,000 to 1,500,000, and preferably it is set to 40,000 to 800,000.

A mass average molecular weight (Mw) of the domain resin which is soluble in toluene can be determined via GPC as a standard polystyrene conversion value. Specifically, it can be measured as follows: using apparatus "HLC-8220" (produced by Tosoh Corp.) and column "TSK guard column with TSK gel Super HZM-M (three in series)" (produced by Tosoh Corp.), as the column temperature is kept at 40° C., tetrahydrofuran (THE) as a carrier solvent is passed at a flow rate of 0.2 ml/min, and a measurement sample (the domain resin which is soluble in toluene) is dissolved in tetrahydrofuran so that the concentration thereof becomes 1 mg/ml under a condition in that dissolution is carried out using an ultrasonic dispersing device at room temperature for 5 minutes. Then a sample solution is obtained via treatment of a membrane filter of a 0.2 μm pore size, and 10 μl thereof is injected into the above apparatus along with the carrier solvent for detection using a refractive index detector (RI detector). From the molecular weight distribution of the measured sample, the molecular weight can be determined by using a calibration curve obtained employing mono-dispersed polystyrene standard particles. Ten kinds of polystyrene particles are employed for obtaining a calibration curve.

In the toner of the present invention, the content of the domain resin is preferably 0.3 to 7.0 mass % of the sum of the matrix resin and the domain resin, and it is more preferably 2.5 to 4.0 mass %.

When the content of the domain resin is within the very small quantity range as described above, the toner has sufficient blocking resistance while it has low-temperature fixability. On the other hand, when the content of the domain resin is excessive, there is a possibility that the toner may not have sufficient blocking resistance. Moreover, when the content of domain resin is too small, the toner may not have sufficient low-temperature fixability, and it may occur that sufficient fold fixability is not acquired, and further, there is a possibility that a hot off-set phenomenon may occur.

(Matrix Phase)

As a matrix phase in the binder resin of the domain-matrix structure, it is preferable that the matrix phase is composed of at least one of a styrene acrylic resin and a polyester resin.

As a styrene acrylic resin, it is preferable to use a random copolymer produced by polymerizable monomers including at least one of a styrene monomer and an acrylic acid monomer.

Polymerizable monomers which form a matrix resin are cited as follows.

Examples of a styrene monomer which forms a styrene acrylic resin include styrene or styrene derivatives such as: styrene, o-methylstyrene, m-methylstyrene, p-methylstyrene, α-methyl styrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These may be used singly or may be used in combination of two or more sorts.

Examples of an acrylic monomer which forms a styrene acrylic resin include: methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; and acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate. These may be used singly or may be used in combination of two or more sorts.

Examples of a multi-valent carboxylic acid which forms a polyester resin include: two valent aliphatic carboxylic acids such as oxalic acid, malonic acid, succinic acid, glutaric acid, adipic acid, pimelic acid,
suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, and n-octenylsuccinic acid; two valent aromatic carboxylic acids such as phthalic acid, isophthalic acid, terephthalic acid, and naphthalene dicarboxylic acid; and three or more valent carboxylic acids such as trimellitic acid, pyromellitic acid, acid anhydrides of these acids, and acid chloride of these acids. These may be used singly or may be used in combination of two or more sorts.

Examples of a polyol which forms a polyester resin include: diols such as ethylene glycol, diethylene glycol, triethylene glycol, 1,2-propylene glycol, 1,3-propylene glycol, 1,4-butanediol, 1,4-butylenediol, neopentyl glycol, 1,5-pentane glycol, 1,6-hexane glycol, 1,7-heptane glycol, 1,8-octanediol, 1,9-nonanediol, 1,10-Deccandiol, pinacol, cyclopentene-1,2-diol, cyclohexane-1,4-diol, cyclohexane-1,2-diol, cyclohexane-1,4-dimethanol, dipropylene glycol, polyethylene glycol, polypropylene glycol, polytetramethylene glycol, bisphenol A, bisphenol Z, and hydrogenated bisphenol A; three or more valent aliphatic polyols such as glycerol, trimethylolethane, trimethylolpropane, pentaerythritol, sorbitol, trisphenol PA, phenol novolak, and cresol novolac; an alkylene oxide adduct of the above-described three or more valent aliphatic polyols. These may be used singly or may be used in combination of two or more sorts.

The glass transition temperature of the matrix resin is preferably in the range of 23 to 58° C.

When the glass transition temperature of the matrix resin is too low, the toner may not have a sufficient degree of blocking resistance and there is a possibility to easily generate aggregation of the toner particles at the time of storage. On the other hand, when the glass transition temperature of the matrix resin is too high, there is a possibility that the toner may not have low-temperature fixability. The glass transition temperature of the matrix resin is preferably to be higher than the glass transition temperature of the domain resin by 2° C. to 122° C. It is supposed that this structure will cause improvement in low-temperature fixability because the viscoelasticity of the toner will be decreased at a lower temperature side when the toner is melt and fixed.

The glass transition temperature of the matrix resin can be measured in the same manner as measurement of the glass transition temperature of the domain resin as described above, except that the measuring portion is changed to the place corresponding to the matrix phase.

[Colorant]

Generally known dyes and pigments can be used as a colorant contained in the toner particles which constitute the toner of the present invention.

As a colorant for obtaining a black toner, it can be used arbitrarily various types of well-known compounds such as carbon black, magnetic substances, dyes, and complex-iron-oxide pigments. As a colorant for obtaining a color toner, it can be used arbitrarily various types of well-known compounds such as dyes and organic pigments.

The colorant for obtaining the toner of each color may be used singly or may be used in combination of two or more sorts.

The content of the colorant is preferably in the range of 1 to 10 mass %, and more preferably, it is in the range of 2 to 8 mass %. When the content of the colorant is less than 1 mass %, the coloring power of the toner may be insufficient. On the other hand, when the content of the colorant exceeds 10 mass %, it may occur releasing of the colorant or adhesion of the colorant to the carrier to result in giving an adverse effect for charging properties of the toner.

The toner particles which constitute the toner of the present invention may contain inner additives such as a releasing agent and a charge controlling agent when required in addition to the binder resin and the colorant.

[Releasing Agent]

The releasing agents used in the toner particles of the present invention are not especially limited. Examples of the releasing agent include: polyethylene wax, oxidation type polyethylene wax, polypropylene wax, oxidation type polypropylene wax, paraffin wax, microcrystalline wax, Fischer Tropsch wax, carnauba wax, rice wax, and candelilla wax.

The content of the releasing agent in the toner particles is usually in the range of 0.5 to 25 mass parts with respect to 100 mass parts of the binder resin, and more preferably it is in the range of 3 to 15 mass parts.

[Charge Controlling Agent]

It can be used various types of well-known compounds such as metal complexes, ammonium salts, and calixarene as a charge controlling agent used in the toner particles of the present invention The content of the charge controlling agent in the toner particles is usually in the range of 0.1 to 10 mass parts with respect to 100 mass parts of binder resin, and more preferably it is in the range of 0.5 to 5 mass parts.

The toner particles constituting the toner of the present invention can be used directly for the toner, however, it may used in the sate of added with external additives such as a lubricant and a cleaning aid in order to improve fluidity, electrostatic property and cleaning property.

Examples of a lubricant include inorganic particles such as: silica, alumina, titanium oxide, zinc oxide, iron oxide, copper oxide, lead oxide, antimony oxide, yttrium oxide, magnesium oxide, barium titanate, ferrite, red oxide, magnesium fluoride, silicon carbide, boron carbide, silicon nitride, zirconium nitride, magnetite, and magnesium stearate.

These inorganic particles are preferably subjected to a surface treatment using a silane coupling agent, a titanium coupling agent, a higher fatty acid, or a silicone oil, from the viewpoints of improving distribution to the surface of the toner particles and environmental stability.

Examples of a cleaning aid include polystyrene particles and polymethyl methacrylate.

Various types of external additives may be used in combination therewith.

The content ratio of an external additive in the toner is preferably in the range of 0.1 to 20 mass % parts with respect to the whole toner.

(Developer)

The toner of the present invention can be used as a magnetic or non-magnetic single-component toner, or it can be used as a double-component developer by mixing with a carrier. When the toner of the present invention is used as a double-component developer, as the carrier constituting the double-component developer, there may be utilized magnetic particles composed of materials conventionally known in the art including metals such as iron, ferrite, and magnetite, or alloys of these metals with aluminium or lead. Specifically, ferrite particles are preferable.

As the carrier, there can be utilized a coated carrier prepared by coating the magnetic particles with a resin, or a resin dispersion type carrier prepared by dispersing magnetic particles in a resin. A resin composition for such coating is not specifically limited.

The volume-based median diameter of the carrier is preferably 15 to 100 μm, it is more preferably 20 to 80 μm. It is possible to determine the volume-based median diameter of a carrier using laser diffraction system particle size distribution meter "HEWS" (produced by SYMPATEC Co.) provided with a wet type dispersing apparatus.

As a preferable carrier, there can be utilized a coated carrier prepared by coating the magnetic particles with a resin, or a resin dispersion type carrier prepared by dispersing magnetic particles in a resin. A resin composition for such coating is not specifically limited. Examples of a resin constituting the coated carrier include: an olefin based resin, a styrene based resin, a styrene-actyl based resin, a silicone based resin, an ester based resin, and a fluorine-containing resin. A resin constituting the resin dispersion type carrier is not also specifically limited, and any of those known in the art may be utilized, including, for example, a styrene-acryl based resin, a polyester resin, a fluorine-containing resin and a phenol resin.

(Preparation Method of Toner)

The preparation method of the toner relating to the present invention is not limited in particular. From the viewpoint of homogeneously dispersing the domain resin into the matrix resin, it is preferable to use an emulsion polymerization association method in which the particles of domain resin (hereafter, they are called as "domain resin particles") and the particles of matrix resin (hereafter, they are called as "matrix resin particles") are aggregated and fused together.

An example of preparation method of the toner of the present invention is specifically shown in the following.

(1) Matrix resin particle dispersion liquid preparation step in which a dispersion liquid A is prepared by dispersing matrix resin particles in an aqueous medium.

(2) Domain resin particle dispersion liquid preparation step in which a dispersion liquid B is prepared by dispersing domain resin particles in an aqueous medium.

(3) Colorant particle dispersion liquid preparation step in which a dispersion liquid C is prepared by dispersing particles of a colorant (hereafter they are called as "colorant particles") in an aqueous medium.

(4) Dispersion liquid mixing step in which the dispersion liquids A, B and C are mixed.

(5) Salting out—aggregation—fusion step in which matrix resin particles, domain resin particles, and colorant particles are salted out, aggregated and fused in an aqueous medium to form toner particles.

(6) Filtration—cleaning step in which toner particles are filtrated from the toner particle dispersion liquid (in an aqueous medium) so as to eliminate the surfactant or other substances from the toner particles.

(7) Drying step in which washed toner particles are dried.

(8) External additive addition step in which an external additive is added to the dried toner particles.

In the present invention, an aqueous medium means a media which is composed of 50 to 100 mass % of water and 0 to 50 mass % of a water-soluble organic solvent. Examples of a water-soluble organic solvent include: methanol, ethanol, isopropanol, butanol, acetone, methyl ethyl ketone, and tetrahydrofuran. An alcoholic organic solvent is preferable since it will not dissolve the prepared resin.

<Preparation Step (1): Matrix Resin Particle Dispersion Liquid Preparation Step>

The matrix resin particles in the dispersion liquid are preferably prepared with an emulsion polymerization method.

In the emulsion polymerization method, the matrix resin particles are formed as follows: at first, a polymerizable monomer which should form a matrix resin is dispersed in an aqueous medium to form emulsified particles (oil droplets), then, a polymerization initiator is supplied to the dispersion to polymerize the polymerizable monomer.

(Polymerization Initiator)

As a polymerization initiator used in the matrix resin particle dispersion liquid preparation step, any polymerization initiators can be suitably used if they are water-soluble. Specific examples of the polymerization initiator include: persulfates (such as potassium persulfate and ammonium persulfate), azo compounds (4,4'-azobis-4-cyanovaleric acid and its salt, 2,2'-azobis(2-amidinopropane) salt), and a peroxide compound.

(Chain Transfer Agent)

In the matrix resin particle dispersion liquid preparation step, generally known chain transfer agents can be used for the purpose of adjusting the molecular weight of the matrix resin. The chain transfer agents are not limited in particular. Examples thereof include: 2-chloroethanol; mercaptans such as octyl mercaptan, dodecyl mercaptan, and t-dodecyl mercaptan; and a styrene dimer.

The matrix resin particles may have a composition of two or more layers each composed of different components.

In this case, the following method may also be adopted. This method contains the steps of: preparing a resin particle dispersion liquid by the emulsion polymerization process (the 1st step polymerization) according to a conventional method; then adding a polymerization initiator and a polymerizable monomer to the prepared resin particle dispersion liquid and carrying out polymerization treatment (the 2nd step polymerization).

<Preparation Step (2): Domain Resin Particle Dispersion Liquid Preparation Step>

The domain resin particles in the dispersion liquid B can be prepared with an emulsion polymerization method or a mini-emulsion polymerization method.

In the emulsion polymerization method, the domain resin particles are formed as follows: at first, a polymerizable monomer which should form a domain resin is dispersed in an aqueous medium to form emulsified particles (oil droplets), then, a polymerization initiator is supplied to the dispersion to polymerize the polymerizable monomer. Further, the domain resin particles in the dispersion liquid B can also be prepared by the method comprising the steps of forming a specific polymer which constitutes the domain resin at first; then dispersing the formed domain resin in an aqueous surfactant solution to emulsify the formed domain resin.

As a polymerization initiator used in the domain resin particle dispersion liquid preparation step, it can be used the same compound usable in the matrix resin particle dispersion liquid preparation step.

The particle size of the domain resin particles in the dispersion liquid B which is prepared in the domain resin particle dispersion liquid preparation step is preferably in the range of 75 to 250 nm in a median diameter.

The volume-based median diameter of the domain resin particles can be measured as follows: placing a few drops of test sample in a graduated cylinder and adding pure water to it; dispersing test sample in pure water using an ultrasonic washing apparatus "US-1" (made by AS ONE Co., Ltd.) to prepare a measurement sample; and measuring the median diameter of the prepared measurement sample using "Microtrac UPA-150" (made by Nikkiso Co., Ltd.)

When the volume-based median diameter of the domain resin particles is too small, the domain phase by domain resin particles cannot be made into a sufficient magnitude. Consequently, the prepared toner may not exhibit an efficient elasticity by the domain resin which is a rubber component. On the other hand, when the volume-based median diameter of the domain resin particles is excessively large, the domain phase by the domain resin particles may be too large, as a result, the prepared toner may not have a sufficient degree of blocking resistance. In addition, it is assumed that one domain phase is formed by one or several pieces of domain resin particles.

<Preparation Step (3): Colorant Particle Dispersion Liquid Preparation Step>

The particle size of the colorant particles prepared in the colorant particle dispersion liquid preparation step is preferably, for example, in the range of 10 to 300 nm in a volume-based median diameter. The volume-based median diameter can be measured using "Microtrac UPA-150" (made by Nikkiso Co., Ltd.)

The inner additives contained in the toner particles concerning the present invention can be introduced as follows: for example, preparing a dispersion liquid of inner additive particles made of inner additives only before Preparation step (4); mixing the dispersion liquid of inner additive particles with dispersion liquids A, B and C in Preparation step (4); and aggregating the inner additive particles with the matrix resin particles, the domain resin particles and the colorant particles in Preparation step (5).

Further, the inner additives can be introduced in the toner as follows: for example, preparing the matrix resin particles in which the matrix resin and the inner additives are fully mixed to a molecular level; and use this matrix resin particles in Preparation step (1). The above-mentioned matrix resin particles in which the matrix resin and the inner additives are fully mixed to a molecular level can be prepared as follows: dissolving the inner additives in a polymerizable monomer which should form the matrix resin; then polymerizing the polymerizable monomer containing the inner additives.

<Preparation Step (4): Dispersion Liquid Mixing Step>

In this dispersion liquid mixing step, it is preferable to add the dispersion liquid B of the domain resin particles to the dispersion liquid A of the matrix resin particles under the condition that the dispersion liquid A of the matrix resin particles have been adjusted to a weak alkaline state of pH 7.5 to 11.

In this dispersion liquid mixing step, a surfactant may be added in order to stably disperse each particle in an aggregated system.

The surfactants which are used in this dispersion liquid mixing step are not limited in particular, and well-known various surfactants can be used. Suitable examples of the surfactants include: salts of sulfonic acid, such as sodium dodecyl benzene sulfonate and sodium aryl alkyl polyether sulfonate; salts of sulfonic acid ester, such as sodium dodecyl sulfate, sodium tetradecyl sulfate, sodium pentadecyl sulfate, and sodium octyl sulfate; and ionic surfactants of fatty acid salts, such as sodium oleate, sodium laurate, sodium caprate, sodium caprylate, sodium caproate, potassium stearate, and calcium oleate.

In addition, the following nonionic surfactants can also be used: polyethylene oxide, polypropylene oxide, combination of polypropylene oxide and polyethylene oxide, ester of polyethylene glycol and higher fatty acid, alkylphenol polyethylene oxide, ester of higher fatty acid and polyethylene glycol, ester of higher fatty acid and a polypropylene oxide, and sorbitan ester.

<Preparation Step (5): Salting Out—Aggregation—Fusion Step>

In this salting out—aggregation—fusion step, aggregation of particles is started by adding an aggregating agent and increasing the temperature of the mixture.

(Aggregating Agent)

As an aggregating agent used in this salting out—aggregation—fusion step, an alkali metal salt and an alkali earth metal are cited, for example. Examples of an alkali metal which constitutes an aggregating agent include: lithium, potassium, and sodium. Examples of an alkali earth metal which constitutes an aggregating agent include: magnesium, calcium, strontium, and barium. Among these, potassium, sodium, magnesium, calcium, strontium, and barium are preferably used. As a counter ion (an anion to form the salt) of an alkali metal salt and an alkali earth metal, it can be cited: chloride ion, bromide ion, iodide ion, carbonate ion, and sulfate ion.

<Preparation Step (6): Filtration—Cleaning Step>

<Preparation Step (7): Drying Step>

<Preparation Step (8): External Additive Addition Step>

These manufacturing processes can be performed according to the filtration step, the cleaning step, the drying step, and external additive addition step which are generally performed in the well-known emulsion polymerization aggregation method.

[Image Formation Method]

The toner of the present invention can be used for the image formation method using a conventional electro photographic method.

According to the present invention, it is possible to achieve a high quality image since the size of the toner particles is basically within the specific range. And, at the same time, it is possible to achieve low-temperature fixability with high heat-resistant storage property and high blocking resistance, since the binder resin has a domain-matrix structure in which a domain phase made of the specific polymer is dispersed in matrix phase. Moreover, it is possible to achieve excellent hot off-set resistant property and high fold fixability.

EXAMPLE

Although the specific embodiments of the present invention will be described hereafter, the present invention is not limited to these.

[Preparation of Matrix Resin Particle Dispersion Liquid [1]]

In a reaction vessel fitted with a stirrer, a temperature sensor, a condenser and a nitrogen gas introducing device were placed 8 mass parts of sodium dodecyl sulfate dissolved and 3,000 mass parts of ion exchanged water and the internal temperature was raised to 80° C., while stirring at a stirring speed of 230 rpm under a nitrogen gas stream. After raised to the said temperature, a polymerization initiator solution of 10 mass parts of potassium persulfate dissolved in 200 mass parts of deionized water was added. Then, the liquid temperature was again raised to 80° C. A mixture of polymerizable monomers described below was added dropwise thereto over a period of 1 hr. After completion of addition, the reaction mixture was heated at 80° C. for 2 hours with stirring to obtain a dispersion liquid of resin particles (1H).

| | |
|---|---|
| Styrene | 480 mass parts |
| n-Buthyl acrylate | 250 mass parts |
| Methacrylic acid | 68 mass parts |
| n-Octyl-3-mercaptopropionate | 16 mass parts |

In a reaction vessel fitted with a stirrer, a temperature sensor, a condenser and a nitrogen gas introducing device was placed 7 mass parts of sodium polyoxyethylene (2) dodecyl ether sulfonate, dissolved in 800 mass parts of deionized water. After the internal temperature was raised to 98° C., 260 mass parts of the foregoing dispersion liquid of resin particles (1H) and a mixture of polymerizable monomers described below were added thereto and mixed with stirring for 1 hour using a mechanical stirring machine having a circulation route (CLEAR MIX, produced by M Technique Co., Ltd.) to prepare a dispersion containing emulsified particles (oil droplets).

| | |
|---|---|
| Styrene | 245 mass parts |
| n-Butyl acrylate | 120 mass parts |
| n-Octyl-3-mercaptopropionate | 1.5 mass parts |

Subsequently, to this dispersion liquid was added a polymerization initiator solution of 6 mass parts of potassium persulfate dissolved in 200 mass parts of deionized water and this system was heated at 82° C. with stirring over 1 hours to perform polymerization to obtain a dispersion liquid of resin particles (1HM).

To the foregoing dispersion liquid of resin particles (1HM) was added a added a polymerization solution of 11 mass parts of potassium persulfate dissolved in 400 ml of deionized water, and a mixture of polymerizable monomers described below was dropwise added over a period of 1 hour at 82° C.

| | |
|---|---|
| Styrene | 435 mass parts |
| n-Buthyl acrylate | 130 mass parts |
| Methacrylic acid | 33 mass parts |
| n-Octyl-3-mercaptopropionate | 8 mass parts |

After completion of addition, stirring was continued with heating for 2 hors to perform polymerization. Thereafter, the reaction mixture was cooled to 28° C. to obtain a dispersion liquid of matrix resin particles [A-1]. The glass transition temperature of the obtained matrix resin particles [A-1] was measured with the following method. The glass transition temperature of the matrix resin particles [A-1] was 37° C.

<Glass Transition Temperature of Matrix Resin Used as a Raw Material>

The glass transition temperature (Tg) of the matrix resin can be determined as follows. The dispersion liquid of matrix resin particles was freeze dried to obtain a dried sample for measurement. Then, about 4.5 mg of the sample was precisely measured to two decimal point, and it was sealed in an aluminum pan and was placed in a sample holder of a differential scanning calorimeter "DSC 8500" (produced by Perkin Elmer, Inc.). An empty aluminum pan is used as the reference measurement. Subsequently, heating-cooling-heating temperature control was carried out over a measurement temperature range of 0 to 200° C. under measurement conditions of a temperature increasing rate of 10° C./min and a temperature decreasing rate of 10° C. min. Measured data was obtained during the second heating stage, and then a glass transition temperature (Tg) was obtained as a value which was read at the intersection of the extension of the base line, prior to the initial rise of the first endothermic peak, with the tangent showing the maximum inclination between the initial rise of the first endothermic peak and the peak summit.

[Preparation of Matrix Resin Particle Dispersion Liquid [2]]

In a heat-dried three necked reaction vessel were placed the raw materials described below. After placing them, under the inactive atmosphere of a nitrogen gas, the mixture was mechanically stirred and refluxed at 180° C. for 5 hours. Then, while eliminating water produced in the reaction mixture under a reduced pressure, the reaction mixture was heated to 240° C. After continuing the dehydro condensation reaction to 240° C. for 3 hours, the molecular weight of the product was measured with GPC (gel permeation chromatography). At the stage where the mass average molecular weight reached 27,000, the reduced pressure distillation was stopped and a polyester resin was obtained.

Bisphenol A—propylene oxide 2 mol adduct

| | |
|---|---|
| Terephthalic acid | 116 mass parts |
| Fumaric acid | 12 mass parts |
| Dodecenyl succinate | 54 mass parts |
| $Ti(OBu)_4$ | 40.05 mass parts |

Next, in a separable vessel were placed 100 mass parts of the produced polyester resin, 50 mass parts of ethyl acetate, 25 mass parts of isopropyl alcohol, and 5 mass parts of 10% aqueous ammonia solution. Then they were dissolved by mixing, while stirring with heating 40° C., ion exchanged water was dropped at a liquid supplying speed of 8 g/min. After the solution became cloudy, the liquid supplying speed was increased to 25 g/min to make phase conversion. When the supplied amount of water became 135 mass parts, the dropping was stopped. Then, by eliminating the solvent under the reduced pressure, a dispersion liquid of matrix resin particles [A-2] was obtained. The glass transition temperature of the matrix resin particles [A-2] was measured with the same method as described above. It was 63° C.

[Preparation of Domain Resin Particle Dispersion Liquid [1]]

In a pressure resistive vessel were placed 500 mass parts of butadiene as a polymerizable monomer, 30 mass parts of styrene, 18 mass parts of methyl methacrylate, and 2 mass parts of acrylic acid, further, were placed 200 mass parts of ion exchanged water, 1 mass part of t-dodecyl mercaptan, 0.2 mass parts of sodium dodecyl benzene sulfonate, and 1 mass part of potassium persulfate. Then, polymerization reaction was performed under a nitrogen gas atmosphere at 70° C. for 2 hours. Subsequently, the reaction was continued for another 3 hours to terminate the polymerization. Thus, it was prepared a latex [LxB1] in which domain resin particles [B1] were dispersed.

With respect to the prepared latex [LxB1], the glass transition temperature and the volume-based median diameter of the domain resin particles [B-1], and toluene insoluble components were measured by the following ways.

(1) Glass Transition Temperature

<Glass Transition Temperature of Domain Resin Used as a Raw Material>

The glass transition temperature (Tg) of the domain resin can be determined as follows. The dispersion liquid of domain resin particles was freeze dried to obtain a dried sample for measurement. Then, about 4.5 mg of the sample was precisely measured to two decimal point, and it was sealed in an aluminum pan and was placed in a sample holder of a differential scanning calorimeter "DSC 8500" (produced by Perkin Elmer, Inc.). An empty aluminum pan is used as the reference measurement Subsequently, heating-cooling-heating temperature control was carried out over a measurement temperature range of 0 to 200° C. under measurement conditions of a temperature increasing rate of 10° C./min and a temperature decreasing rate of 10° C. min. Measured data was obtained during the second heating stage, and then a glass transition temperature (Tg) was obtained as a value which was read at the intersection of the extension of the base line, prior to the initial rise of the first endothermic peak, with the tangent showing the maximum inclination between the initial rise of the first endothermic peak and the peak summit (2) Volume-Based Median Diameter The volume-based median diameter can be measured as follows: placing a few drops of the latex [LxB1] in a graduated cylinder and adding 25 ml of pure water to it; dispersing the latex in pure water for 3 minutes using an ultrasonic washing apparatus "US-1" (made by AS ONE Co., Ltd.) to prepare a measurement sample; and putting 3 ml of the measurement sample in "Microtrac UPA-150" (made by Nikkiso Co., Ltd.). The measurement was done after confirming that Sample Loading value was within the range of 0.1 to 100 under the conditions described below.

| [Measurement conditions] | |
|---|---|
| Transparency: | Yes |
| Refractive index: | 1.59 |
| Particle Density: | 1.05/cm3 |
| Spherical Particle: | Yes |
| [Solvent conditions] | |
| Refractive Index: | 1.33 |
| Viscosity: | High(temp) $0.797 \times 10^{-3}$ Pa · S; Low(temp) $1.002 \times 10^{-3}$ Pa · S |

(3) Toluene Insoluble Components

The content of the toluene insoluble components can be measured as follows: adjusting the pH value of the latex [LxB1] to pH 7.5; coagulating the latex by introducing in isopropanol agitated; the coagulated material was separated, then washed and dried; a predetermined amount (about 0.03 g) of the measuring sample was immersed in a predetermined amount (about 100 ml) of toluene at 20° C. for 20 hours; then the toluene solution was filtered using a metal net having 120 mesh. The content (mass %) of the toluene insoluble components was calculated from the obtained residual solid components with respect to the mass of the measuring sample initially used.

[B-17], and toluene insoluble components were measured respectively by the above-described ways. The results are shown in Table 1.

[Preparation of Comparative Domain Resin Particle Dispersion Liquids [1] to [4]]

There were prepared Latexes [LxC1] to [LxC4] each respectively containing dispersed domain resin particles [C-1] to [C-4] in the same manner as the domain resin particle dispersion liquid preparation 1, except that the kinds and the amount of the added components were changed as described in Table 1.

With respect to the prepared latexes [LxC1] to [LxC4], the glass transition temperature and the volume-based median diameter of the domain resin particles [C-1] to [C-4], and toluene insoluble components were measured respectively by the above-described ways. The results are shown in Table 1.

TABLE 1

| | | Domain resin particle No. | | | | | | | | | | |
|---|---|---|---|---|---|---|---|---|---|---|---|---|
| | | B-1 | B-2 | B-3 | B-4 | B-5 | B-6 | B-7 | B-8 | B-9 | B-10 | B-11 |
| | | Latex No. | | | | | | | | | | |
| | | LxB1 | LxB2 | LxB3 | LxB4 | LxB5 | LxB6 | LxB7 | LxB8 | LxB9 | LxB10 | LxB11 |
| Butadiene | Mass parts | 50 | 65 | 25 | 50 | 40 | 20 | 70 | 75 | 80 | 50 | 25 |
| Isoprene | | — | — | — | — | — | — | — | — | — | — | — |
| Styrene | | 30 | 35 | 65 | 30 | 50 | 70 | 30 | 25 | 18 | 30 | 65 |
| Methyl acrylate | | 18 | 18 | 8 | 18 | 7 | 7 | 18 | 17 | — | 20 | 10 |
| Acrylonitrile | | — | — | — | — | — | — | — | — | — | — | — |
| Acrylic acid | | 2 | 2 | 2 | — | 3 | — | 2 | 3 | 1 | — | — |
| Itaconic acid | | — | — | — | 2 | — | 3 | — | — | — | — | — |
| n-Monobutyl maleate | | — | — | — | — | — | — | — | — | — | — | — |
| t-dodecyl mercaptan | | 1 | 1 | 1 | 1 | 1 | 1 | 1 | 1 | 1 | 1 | 1 |
| Dodecyl benzene sulfonic acid | | 0.2 | 0.2 | 0.2 | 0.4 | 0.1 | 0.2 | 0.2 | 0.2 | 0.2 | 0.2 | 0.2 |
| Potassium persulfate | | 1 | 1 | 2 | 1 | 1 | 1 | 1 | 1 | 1 | 1 | 1 |
| Cumene hydroperoxide | | — | — | — | — | — | — | — | — | — | — | — |
| Glass transition temperature | [° C.] | −20 | −40 | 30 | −20 | 0 | 35 | −45 | −55 | −70 | −20 | 30 |
| Volume-based median diameter | [nm] | 150 | 150 | 130 | 60 | 250 | 130 | 150 | 150 | 150 | 150 | 130 |
| Toluene insoluble components | [Mass %] | 56 | 66 | 90 | 78 | 59 | 30 | 61 | 59 | 65 | 71 | 79 |

| | | Domain resin particle No. | | | | | | | | | |
|---|---|---|---|---|---|---|---|---|---|---|---|
| | | B-12 | B-13 | B-14 | B-15 | B-16 | B-17 | C-1 | C-2 | C-3 | C-4 |
| | | Latex No. | | | | | | | | | |
| | | LxB12 | LxB13 | LxB14 | LxB15 | LxB16 | LxB17 | LxC1 | LxC2 | LxC3 | LxC4 |
| Butadiene | Mass parts | 20 | 80 | — | 98 | — | 59 | 40 | 40 | 27 | 100 |
| Isoprene | | — | — | 50 | — | 98 | — | — | — | — | — |
| Styrene | | 77 | 185 | 30 | — | — | — | 50 | 50 | 70 | — |
| Methyl acrylate | | — | — | 18 | — | — | — | — | — | — | — |
| Acrylonitrile | | — | — | — | — | — | 34 | — | — | — | — |
| Acrylic acid | | 1 | 1 | 2 | 2 | 2 | — | 0 | 1 | 1 | — |
| Itaconic acid | | — | 4 | — | — | — | — | 1.5 | 1 | 5 | — |
| n-Monobutyl maleate | | — | — | — | — | — | 7 | — | — | — | — |
| t-dodecyl mercaptan | | 1 | 1 | 1 | 1 | 1 | — | — | — | — | — |
| Dodecyl benzene sulfonic acid | | 0.2 | 0.2 | 0.2 | 0.2 | 0.2 | — | 0.05 | 1.8 | 0.2 | 0.2 |
| Potassium persulfate | | 1 | 1 | 2 | 1 | 1 | — | — | — | — | — |
| Cumene hydroperoxide | | — | — | — | — | — | 1 | — | — | — | — |
| Glass transition temperature | [° C.] | 35 | −74 | −15 | −85 | −75 | −45 | 0 | 0 | 40 | −90 |
| Volume-based median diameter | [nm] | 130 | 140 | 155 | 140 | 160 | 275 | 320 | 48 | 120 | 120 |
| Toluene insoluble components | [Mass %] | 14 | 97 | 53 | 44 | 40 | 61 | 90 | 34 | 95 | 10 |

[Preparation of Domain Resin Particle Dispersion Liquids [2] to [17]]

There were prepared Latexes [LxB2] to [LxB17] each respectively containing dispersed domain resin particles [B-2] to [B-17] in the same manner as the domain resin particle dispersion liquid preparation 1, except that the kinds and the amount of the added components were changed as described in Table 1.

With respect to the prepared latexes [LxB2] to [LxB17], the glass transition temperature and the volume-based median diameter of the domain resin particles [B-2] to

[Preparation Shell Resin Particle Dispersion Liquid [1]]

In a polymerization reaction vessel fitted with a stirrer, a temperature sensor a cooling tube, and a nitrogen introducing device were placed 2,948 mass parts of pure water and 2.3 mass parts of an anionic surfactant "EMAL 2FG" (produced by KAO Co., Ltd.). The mixture wad stirred to dissolve followed by heating at 80° C. under nitrogen flow. Then, there was prepared a monomer mixture solution containing 520 mass parts of styrene, 184 mass parts of n-butyl acrylate, 96 mass parts of methacrylic acid and 22.1 mass parts of n-octyl mercaptan. Further, there was prepared a polymerization initiator solution containing 10.2 mass parts of potassium persulfate dissolved in 218 mass parts of pure water. The polymerization initiator solution was dropped to the foregoing monomer mixture solution spending 3 hours, and the polymerization reaction was carried out for another 1 hour. Thus maintained at the same temperature for one hour to complete polymerization reaction shell resin particle dispersion liquid [1] was prepared.

[Preparation of Colorant Particle Dispersion Liquid [1]]

While stirring a surfactant solution containing 90 mass parts of sodium dodecyl sulfate dissolved in 1,600 mass parts of ion exchanged water, there was gradually added 420 mass parts of carbon black "Regal 330R" (made by Cabot Corporation), then a dispersing treatment was conducted employing "CLEAR MIX" (made by M Technique Co.) to obtain colorant particle dispersion liquid [1]. The volume-based median diameter of the prepared colorant particle dispersion liquid [1] was measured employing an electrophoretic light scattering photometer ELS-800 (manufactured by Otsuka Electronics Co., Ltd.). It was determined to be 110 nm.

[Preparation of Releasing Agent Particle Dispersion Liquid [1]]

While stirring a surfactant solution containing 90 mass parts of sodium dodecyl sulfate dissolved in 1,600 mass parts of ion exchanged water, there was gradually added 420 mass parts of microcrystalline wax (melting point: 87° C.), and the mixture was heated to 100° C., then a dispersing treatment was conducted employing "Manton-Gaulin homogenizer" (made by Gaulin Co., Ltd.) to obtain releasing agent particle dispersion liquid [1]. The volume-based median diameter of the prepared releasing agent particle dispersion liquid [1] was measured employing an electrophoretic light scattering photometer ELS-800 (manufactured by Otsuka Electronics Co., Ltd.). It was determined to be 340 nm.

[Preparation of Toner [1]]

In a reaction vessel fitted with a stirrer, a temperature sensor, a condenser and a nitrogen gas introducing device were placed 300 mass parts (solid portion converted value) of matrix resin particles [A-1], 9 pass parts (solid portion converted value) of latex [LxB1] of domain resin particles [B-1], 1,400 mass parts of ion exchanged water, 120 mass parts of colorant particle dispersion liquid [1], 120 mass parts of releasing agent particle dispersion liquid [1], and 123 mass parts of an aqueous solution containing 3 mass parts of sodium polyoxyethylene(2) dodecyl ether sulfonate dissolved in 120 mass parts of ion exchanged water. Then the liquid temperature was adjusted to 30° C.

The pH value of the solution was adjusted to 10 with an aqueous 5N sodium hydroxide solution. Subsequently, an aqueous solution containing 35 mass parts of magnesium chloride dissolved in 35 mass parts of ion exchanged water was added thereto at 30° C. over 10 minutes with stirring. After completion of the addition, the mixture was stand still for 3 minutes, then the temperature was raised to 90° C. over 60 minutes to promote particle growth reaction. While measuring aggregated particle sizes using "COULTER MULTISIZER III" (made by Beckman Coulter Co., Ltd.) and when reached a volume-based median diameter of 6.5 μm, 30 mass parts of shell resin particle dispersion liquid [1] (solid portion converted value) was added and the mixture was stirred for 1 hour to fuse the shell resin particles to the surface of the particles. Then, 750 mass parts of an aqueous 20% sodium chloride solution was added thereto to terminate particle growth. Further, after completely forming the shell by continued stirring for another 30 minutes, the aqueous 20% sodium chloride solution was added and stirring was continued at keeping the liquid temperature at 98° C. While observing the average circularity of the aggregated particles with a flow type particle image measuring device "FPIA-2100" (manufactured by Sysmex Corp.), the fusion of the aggregated particles was promoted. When the average circularity of the aggregated particles reached 0.965, the liquid temperature was cooled to 30° C. and the pH was adjusted to 4.0 with hydrochloric acid, then stirring was terminated.

Thus formed aggregated particles were subjected to solid/liquid separation by using a basket type centrifugal separator, MARK III type No. 60×40 (produced by Matsumoto Kikai Co., Ltd.) to form a wet cake of the aggregated particles. The wet cake was washed with 45° C. ion exchanged water by using the basket type centrifugal separator until the filtrate reached an electric conductivity of 5 μS/cm, it was transferred to Flash Jet Dryer (produced by Seishin Kigyo Co.) and was dried until reached a moisture content of 0.5 mass % to obtain toner particles [1].

The volume-based median diameter of the prepared toner particles [1] was 6.6 μm, and the average circularity thereof was 0.965. Incidentally, the volume-based median diameter and the average circularity of the toner particles were measured with the methods described above. It is the same as below.

To the toner particles [1], were added 1 mass % of hydrophobic silica (having a number average primary particle diameter of 12 nm) and 0.3 mass % of hydrophobic titania (having a number average primary particle diameter of 20 nm) and they were mixed employing a Henschel mixer (produced by Mitsui Miike Kakoki Co.). Thereafter, coarse particles were removed using a sieve having an opening of 45 arm to prepare toner [1]. Incidentally, addition of hydrophobic silica did not cause variation in particle size to the toner particles.

[Preparation Example Toners [2] to [17]]

Toners [2] to [17] each respectively containing toner particles [2] to [17] were prepared in the same manner as the foregoing preparation of the toner [1], expect that the kind and the addition amount of the domain resin particles were changed as described in Table 2. The volume-based median diameter and the average circularity of the toner particles [2] to [17] are shown in Table 2.

TABLE 2

| | | | Matrix resin | | | Domain resin | | | | |
|---|---|---|---|---|---|---|---|---|---|---|
| Toner No. | Volume-based median diameter of toner particles (μm) | Average circularity of toner particles | Matrix resin particle No. | Added amount (mass parts) | Glass transition temperature (° C.) | Domain resin particle No. | Added amount (mass parts) | Ferret diameter of domain phase (nm) | Variation efficient of Ferret diameter (%) | Glass transition temperature (° C.) |
| 1 | 6.6 | 0.965 | A-1 | 300 | 37 | B-1 | 9 | 150 | 12 | −21 |
| 2 | 6.6 | 0.967 | A-1 | 300 | 37 | B-2 | 9 | 140 | 12 | −39 |
| 3 | 6.7 | 0.952 | A-1 | 300 | 37 | B-3 | 9 | 120 | 13 | 30 |
| 4 | 6.6 | 0.961 | A-1 | 300 | 37 | B-4 | 9 | 55 | 16 | −21 |

TABLE 2-continued

| Toner No. | Volume-based median diameter of toner particles (μm) | Average circularity of toner particles | Matrix resin: Matrix resin particle No. | Matrix resin: Added amount (mass parts) | Matrix resin: Glass transition temperature (° C.) | Domain resin: Domain resin particle No. | Domain resin: Added amount (mass parts) | Domain resin: Ferret diameter of domain phase (nm) | Domain resin: Variation efficient of Ferret diameter (%) | Domain resin: Glass transition temperature (° C.) |
|---|---|---|---|---|---|---|---|---|---|---|
| 5 | 6.7 | 0.951 | A-1 | 300 | 37 | B-5 | 9 | 270 | 17 | 0 |
| 6 | 6.5 | 0.948 | A-1 | 300 | 37 | B-6 | 9 | 120 | 13 | 35 |
| 7 | 6.6 | 0.965 | A-1 | 300 | 37 | B-7 | 9 | 155 | 14 | −44 |
| 8 | 6.5 | 0.966 | A-1 | 300 | 37 | B-8 | 15 | 160 | 16 | −53 |
| 9 | 6.6 | 0.966 | A-1 | 300 | 37 | B-9 | 6 | 160 | 12 | −68 |
| 10 | 6.7 | 0.964 | A-1 | 300 | 37 | B-10 | 9 | 150 | 24 | −20 |
| 11 | 6.5 | 0.952 | A-1 | 300 | 37 | B-11 | 21 | 125 | 25 | 30 |
| 12 | 6.9 | 0.982 | A-1 | 300 | 37 | B-12 | 18 | 150 | 22 | 35 |
| 13 | 6.9 | 0.966 | A-1 | 300 | 37 | B-13 | 6 | 145 | 23 | −72 |
| 14 | 6.6 | 0.964 | A-1 | 300 | 37 | B-14 | 12 | 170 | 22 | −15 |
| 15 | 6.6 | 0.942 | A-1 | 300 | 37 | B-15 | 1 | 158 | 21 | −85 |
| 16 | 6.6 | 0.941 | A-1 | 300 | 37 | B-16 | 9 | 155 | 24 | −75 |
| 17 | 6.8 | 0.937 | A-1 | 300 | 37 | B-17 | 9 | 148 | 24 | −44 |

[Preparation of Toner [18]]

In a reaction vessel fitted with a pH meter, a stirrer, a temperature sensor were placed 300 mass parts of matrix resin particles [A-2] (solid portion converted value), 32 mass parts of sodium dodecyl benzene sulfonate and 1,278 mass parts of ion exchanged water, and the surfactant was sufficiently mixed while stirring the mixture at 200 rpm for 15 minutes. To this mixture were added 9 mass parts (solid portion converted value) of latex [LxB1] of domain resin particles [B-1], 120 mass parts of colorant particle dispersion liquid [1], and 120 mass parts of releasing particle dispersion liquid, followed by mixing them. Then, the pH value of the mixed raw materials was adjusted to 2.8 with an aqueous 0.3N nitric acid solution of. Subsequently, while applying a shearing stress at 1,000 rpm using "ULTRA-TURRAX" (made by IKA Japan Co., Ltd.), there was dropped 250 mass parts of an aqueous 10% aluminium sulfate solution as an aggregating agent. Since the viscosity of the mixed raw materials was increased during the addition of this aggregating agent, attention was paid so that the dropping speed was slowed down when the viscosity rose in order to control disparity of the aggregating agent in one spot. After completion of the addition of the aggregating agent, the mixture was stirred at an increased stirring rate of 6,000 rpm for 5 minutes so that the aggregating agent and the mixed raw materials were fully mixed. Next, the above-mentioned mixed raw materials were stirred at 550 to 650 rpm with heating at 30° C. with a mantle heater. After stirring for 60 minutes, the temperature of the mixture was increased to 45° C. with an increasing rate of 0.5° C./minute for the purpose of promoting the growth of the aggregation particles. Separately, there was prepared shell resin particle dispersion liquid [1] which was adjusted to pH 2.7 for coating the aggregated particles, by mixing 411 mass parts (solid portion converted value) of a dispersion liquid of the matrix resin particles [A-2], 145 mass parts of ion exchanged water, and 15 mass pats of anion surfactant (sodium dodecyl benzene sulfonate). At the point when the aggregated particles grew up to the size of 5.0 μm in the above-described aggregation step, the aforesaid shell resin particle dispersion liquid [1] was added, and kept for 10 minutes while stirring. Then, 33 mass parts of an aqueous EDTA solution and an aqueous 1M sodium hydroxide solution were added in this order to stop the growth of the core-shell aggregated particles having coated a shell, and the pH value of the mixed raw materials was adjusted to 7.5. Subsequently, while the pH value was adjusted to 6.5, the temperature of the mixture was increased to 85° C. with an increasing rate of 1° C./minute. After confirming that the aggregated particles were fused with an optical microscope, the mixture was cooled rapidly with introducing water with ice.

Next, the pH value of the prepared particles in a cooled shiny was adjusted to 9.0 with an aqueous 1N sodium hydroxide solution, and the slurry was stirred for 20 minutes, followed by filtrated with a filter of 20 μm mesh. Then, there was added 10 times amount of warm water (50° C.) with respect to the solid portion, and again it was stirred for 20 minutes with adjusting the pH value to 9.0 to perform warm alkali washing, and the mixture was filtrated. The solid portion remained on the filter was again dispersed in the slurry and the slurry was washed 3 times with warm water (40° C.). Further, an acidic wash was performed at 40° C. by adding an aqueous 0.3N nitric acid solution to the slurry. Finally, washing with stirring was performed with warm ion exchanged water at 40° C., and it was dried to obtain toner particles [18]. The obtained toner particles [18] had a volume-based median diameter of 5.2 μm and an average circularity of 0.952.

To the toner particles [18], were added 0.9 mass % of silica particles (having a number average primary particle diameter of 50 nm) and 0.6 mass % of titania particles (having a number average primary particle diameter of 40 nm) and they were mixed employing a Henschel mixer (produced by Mitsui Miike Kakoki Co.). Thereafter, coarse particles were removed using a sieve having an opening of 45 μm to prepare toner [18].

[Preparation of Toners [19] to [25]]

Toners [19] to [25] each respectively contain toner particles [19] to [25] were prepared in the same manner as the foregoing preparation example 18 of toner, expect that the kind and the addition amount of the domain resin particles were changed as described in Table 3. The volume-based median diameter and the average circularity of the toner particles [19] to [25] are shown in Table 3. The volume-based median diameter and the average circularity were measured with the methods described above.

[Preparation Example of Toner [26]]

Toners [26] contain toner particles [26] was prepared in the same manner as the foregoing preparation example 1 of toner, expect that the domain resin particles were not used and the amount of the dispersion liquid of the matrix resin particles was changed to 315 mass parts (solid portion converted values) in Table 3. The volume-based median diameter and the average circularity of the toner particles [26] are shown in Table 3.

[Preparation of Toners [27] to [30]]

Toners [27] to [30] each respectively contain toner particles [27] to [30] were prepared in the same manner as the foregoing preparation example 18 of toner, expect that the kind and the addition amount of the domain resin particles were changed as described in Table 3. The volume-based median diameter and the average circularity of the toner particles [27] to [30] are shown in Table 3. The volume-based median diameter and the average circularity were measured with the methods described above.

TABLE 3

| | | | Matrix resin | | | Domain resin | | | | |
|---|---|---|---|---|---|---|---|---|---|---|
| Toner No. | Volume-based median diameter of toner particles (μm) | Average circularity of toner particles | Matrix resin particle No. | Added amount (mass parts) | Glass transition temperature (° C.) | Domain resin particle No. | Added amount (mass parts) | Ferret diameter of domain phase (nm) | Variation efficient of Ferret diameter (%) | Glass transition temperature (° C.) |
| 18 | 5.2 | 0.952 | A-2 | 300 | 62 | B-1 | 12 | 155 | 12 | −21 |
| 19 | 5.2 | 0.951 | A-2 | 300 | 62 | B-2 | 12 | 155 | 12 | −39 |
| 20 | 5.2 | 0.955 | A-2 | 300 | 62 | B-3 | 12 | 125 | 13 | 30 |
| 21 | 5.2 | 0.952 | A-2 | 300 | 62 | B-4 | 12 | 90 | 16 | −21 |
| 22 | 5.3 | 0.952 | A-2 | 300 | 62 | B-5 | 12 | 280 | 17 | 0 |
| 23 | 5.3 | 0.956 | A-2 | 300 | 62 | B-6 | 12 | 130 | 13 | 35 |
| 24 | 5.2 | 0.951 | A-2 | 300 | 62 | B-7 | 12 | 160 | 14 | −44 |
| 25 | 5.2 | 0.952 | A-2 | 300 | 62 | B-10 | 12 | 155 | 21 | −20 |
| 26 | 6.5 | 0.965 | A-1 | 315 | 63 | None | 0 | — | — | — |
| 27 | 6.5 | 0.955 | A-1 | 300 | 37 | C-1 | 9 | 325 | 27 | 0 |
| 28 | 6.6 | 0.964 | A-1 | 300 | 37 | C-2 | 9 | 47 | 15 | 0 |
| 29 | 6.5 | 0.965 | A-1 | 300 | 37 | C-3 | 9 | 120 | 12 | 40 |
| 30 | 6.6 | 0.966 | A-1 | 300 | 37 | C-4 | 9 | 120 | 25 | −90 |

Feret diameters of the domain phase shown in Table 2 and Table 3 were measured with the following procedure.

A portion of the toner particles was embedded in an epoxy resin and a thin leaf sample was cut to have a thickness of 100 nm using a microtome. And the cut sample was dyed with osmium to prepare an ultra thin leaf sample for observation. A photograph with 10,000 times of magnification was taken for this thin leaf sample for observation using a transmission electron microscope "H-7500" (made by Hitachi, Ltd.). The taken picture was subjected to binary processing. Feret diameter in a horizontal direction of 100 domain phases is respectively measured. The arithmetic average value thereof is used as the magnitude of the domain phase.

Toner particles [1] to [25] each were cut using a microtome to paper a thin leaf sample for observation having a thickness of 100 nm and dyed with osmium. The prepared thin leaf sample for observation was measured with a transmission electron microscope "JEM-2000FX" (made by JEOL, Ltd.) under the condition of accelerating voltage of 80 kV and magnification of 30,000 times. It was confirmed that they have a domain-matrix structure in which a domain resin was dispersed in a matrix resin.

With respect to the prepared toner particles [1] to [25], the glass transition temperature and the volume-based median diameter of the domain resin and the matrix resin were measured by the following ways. The results are shown in Table 2 and Table 2.

<Glass Transition Temperature of the Domain Resin Used in the Toner Particles>

The test sample was prepared by cooling with a liquid nitrogen gas, and the domain resin and the matrix resin were measured using a local thermal analysis system "Nano thermal analysis system (Nano-TA)" (made by Japan Thermal Consulting Co. Ltd.). Namely, a thermal probe is contacted to measuring regions (a portion corresponding to a domain phase and a portion corresponding to a matrix phase) of the test sample prepared by cutting smoothly, and the temperature of the thermal probe is increased. The temperature point at which the deflection voltage corresponding to a penetration depth changed from increase to decrease was determined as a glass transition temperature.

[Preparation of Developers [1] to [26]]

Developers [1] to [26] each were respectively prepared by mixing the toners [1] to [26] and a ferrite carrier having a volume-based median diameter of 60 μm coated with a silicone resin in such a way that the foregoing toner had a content of 6 mass %.

Examples 1 to 25, and Comparative Example 1

Each of the above-described developers [1] to [26] was respectively introduced in a modified commercially available digital copying machine "bizhub 421" (manufactured by Konica Minolta Business Technologies, Inc.). Then, the following evaluations 1 to 4 were carried out. The evaluation results are shown in Table 4.

[Evaluation 1: Fixable Temperature Range]

The commercially available digital copying machine "bizhub 421" (manufactured by Konica Minolta Business Technologies, Inc.) was modified so that printing speed became 84 sheets per minute (two times higher than the printing speed of the original machine), and the surface temperature of the heat roller in the fixing device was variable in the range of 120 to 210° C. Under the condition of normal temperature and normal humidity (temperature 20° C. and relative humidity 55%), it was performed fixing experiment of a solid stripe image having 5 mm width in the direction of the axis of the heat roller. The set up fixing temperatures (the surface temperature of the heat roller) were changed by increasing from 120° C., 125° C., etc., with an interval of 5° C., and the fixing experiment was repeated.

In each fixing experiment, the obtained fixed image was rubbed 10 times with a pressure of 1 Pa using a bleached cotton. The reflection densities of the image before rubbed and after rubbed were measured. From the difference of the reflection density, the fixing rate was determined according to the following scheme (1). Among the fixing experiments which attained the fixing rate of 70% or more, the fixing temperature showing the lowest temperature in each fixing experiment was determined as a lowest fixing temperature of each sample.

Fixing rate={(Reflection density after rubbed)/(Reflection density before rubbed)}×100 Scheme (1)

Further, among the fixing experiments in which were visually observed the image stain caused by hot off-set, the fixing temperature showing the lowest temperature in each fixing experiment was determined as a lowest hot off-set temperature of each sample. In Table 4, "Not occurred" indicates that there was occurred no hot off-set till 210° C.

[Evaluation 2: Fold Fixability]

It was used the commercially available digital copying machine "bizhub 421" (manufactured by Konica Minolta Business Technologies, Inc.) modified so that printing speed became 84 sheets per minute (two times higher than the printing speed of the original machine), and the surface temperature of the heat roller in the fixing device was set to 170° C. Under the condition of normal temperature and normal humidity (temperature 20° C. and relative humidity 55%), a black solid image having an image density of 0.8 was formed and it was fully cooled (this state was designated as "before folding"). Then the black solid image was folded and the folded portion was rubbed 3 times with a finger followed by unfolding the folded black solid image and wiped 3 times with a paper "JK Wiper" (made by Nippon Paper Clesia Co., Ltd.) (this state was designated as "after folding"). From the image densities measured at "before folding" and "after folding", the fold fixing rate was determined according to the following scheme (2).

Fold fixing rate={(Image density after folding)/(mage density before folding)}×100 Scheme (2)

[Evaluation 2: Blocking Resistance]

In a glass bottle having an inner diameter of 21 mm and a capacity of 10 ml was placed 0.5 g of a toner sample, then closed with a cap. The bottle was shaken 600 times at room temperature using Tap Denser "KYT-2000" (made by Seishin Enterprise Co., Ltd.). Subsequently, the toner sample in the bottle was left under the condition of 55° C. humidity of 35% RH for 2 hours with the cap taken. Then the toner was placed on a sieve of 48 mesh (open space 350 μm) with a precaution of not braking the toner aggregate, and it was set on "Powder Tester" (made by Hosokawa Micron Corporation), and it was held with a holding bar and a knob nut. The vibration strength was adjusted to the shift width of 1 mm and give vibration for 10 seconds. After the vibration, the amount of the remaining toner on the sieve was measured. The toner aggregation rate was determined according to the following scheme (3). When the toner aggregation rate was 20 mass % or less, the toner was considered to meet the standard and to have practically no problem.

Toner aggregation rate={(Amount of the remaining toner on the sieve (g))/0.5 (g)}×100 Scheme (3)

[Evaluation 4: Image Quality]

It was used the commercially available digital copying machine "bizhub 421" (manufactured by Konica Minolta Business Technologies, Inc.) modified so that printing speed became 84 sheets per minute (two times higher than the printing speed of the original machine). "The Imaging Society of Japan Test Chart No. 4" (made by the first division of the Imaging Society of Japan) was printed by the above-mentioned digital copying machine. The patch image corresponding to 200 lines 30% was observed visually and also using a loupe having a 20 times magnification to perform evaluation of image quality. The evaluation was focused on the smooth feeling of the image and dust between the dots and ranked based on the following criteria.

Evaluation Criteria

A: Showing excellent granularity and no roughness when visually observed, further, and there are recognized no toner particles causing a dust between dots when observed with a loupe having a 20 times magnification B: Showing slight roughness when visually observed with attention, or there are recognized one to three toner particles between dots when observed with a loupe having a 20 times magnification C: Showing intensive roughness and a high degree of roughness when visually observed, or there are recognized an uncountable number of toner particles when observed with a loupe having a 20 times magnification

TABLE 4

| | | Fixable temperature range | | Fold fixability | Blocking resistance | |
|---|---|---|---|---|---|---|
| | Developer No. | Lowest fixing temperature (° C.) | Hot off-set temperature (° C.) | Fold fixing rate (%) | Toner aggregation rate (%) | Image quality |
| Example 1 | 1 | 130 | Not occurred | 95 | 10 | A |
| Example 2 | 2 | 145 | Not occurred | 90 | 12 | A |
| Example 3 | 3 | 135 | Not occurred | 85 | 7 | A |
| Example 4 | 4 | 140 | Not occurred | 90 | 11 | A |
| Example 5 | 5 | 135 | Not occurred | 80 | 17 | A |
| Example 6 | 6 | 160 | Not occurred | 75 | 12 | B |
| Example 7 | 7 | 155 | 210 | 75 | 12 | B |
| Example 8 | 8 | 155 | 210 | 78 | 16 | B |
| Example 9 | 9 | 150 | 210 | 74 | 17 | B |
| Example 10 | 10 | 150 | 210 | 70 | 19 | B |
| Example 11 | 11 | 150 | 210 | 70 | 20 | B |
| Example 12 | 12 | 150 | 205 | 85 | 18 | B |
| Example 13 | 13 | 160 | Not occurred | 80 | 17 | B |
| Example 14 | 14 | 145 | 210 | 75 | 20 | B |
| Example 15 | 15 | 160 | 210 | 78 | 20 | B |
| Example 16 | 16 | 150 | 210 | 75 | 19 | B |
| Example 17 | 17 | 160 | 210 | 77 | 15 | B |
| Example 18 | 18 | 125 | Not occurred | 95 | 9 | B |
| Example 19 | 19 | 140 | Not occurred | 95 | 11 | B |
| Example 20 | 20 | 130 | Not occurred | 95 | 8 | B |
| Example 21 | 21 | 130 | Not occurred | 85 | 12 | B |
| Example 22 | 22 | 130 | Not occurred | 90 | 16 | B |
| Example 23 | 23 | 160 | Not occurred | 75 | 14 | B |
| Example 24 | 24 | 150 | 210 | 78 | 14 | B |
| Example 25 | 25 | 150 | 210 | 79 | 20 | B |

TABLE 4-continued

| | | Fixable temperature range | | Fold fixability | Blocking resistance | |
|---|---|---|---|---|---|---|
| | Developer No. | Lowest fixing temperature (° C.) | Hot off-set temperature (° C.) | Fold fixing rate (%) | Toner aggregation rate (%) | Image quality |
| Comp. 1 | 26 | 160 | 195 | 60 | 27 | C |
| Comp. 2 | 27 | 160 | 195 | 60 | 35 | C |
| Comp. 3 | 28 | 160 | 190 | 65 | 30 | C |
| Comp. 4 | 29 | 160 | 195 | 70 | 20 | B |
| Comp. 5 | 30 | 155 | 185 | 65 | 42 | C |

Comp.: Comparative example

From the evaluation results shown in Table 4, it was confirmed that in Examples 1 to 25 according to the present invention, there was produced an image of high quality, and low temperature fixability was realized with achieving high blocking resistance. Moreover, it was also confirmed that excellent hot off-set property and high fold fixability were obtained.

What is claimed is:

1. An electrostatic image developing toner comprising, toner particles containing:

(i) a binder resin having a domain-matrix structure; and (ii) a colorant;

wherein the toner particles have a volume-based median diameter of 4.3 to 7.0 μm;

a matrix phase in the binder resin is composed of a polymer of a styrene-acrylic resin or a polyester resin;

a domain phase in the binder resin comprises a polymer containing a structure unit derived from a diene monomer, the domain phase has a Feret diameter of 50 to 300 nm; and a glass transition temperature of the polymer composing the domain phase is −85 to +35° C.

2. The electrostatic image developing toner of claim 1, wherein the polymer composing the domain phase contains a structure unit derived from an acidic monomer.

3. The electrostatic image developing toner of claim 2, wherein the acidic monomer contains a carboxylic group.

4. The electrostatic image developing toner of claim 2, wherein the acidic monomer forms a copolymer and a content of the acidic monomer in the copolymer is 1 to 5 mass %.

5. The electrostatic image developing toner of claim 1, wherein the polymer composed of the domain phase is a styrene-butadiene rubber, and a copolymerization ratio of styrene to butadiene is between 30:70 and 50:50.

6. The electrostatic image developing toner of claim 1, wherein the domain phase has a Feret diameter of 75 to 250 nm.

7. The electrostatic image developing toner of claim 1, wherein a variation coefficient of a particle size distribution in the Ferret diameter of domain phases is 20% or less.

8. The electrostatic image developing toner of claim 1, wherein a content ratio of toluene insoluble components contained in the polymer composing the domain phase is from 15 to 95 mass %.

9. The electrostatic image developing toner of claim 1, wherein a content ratio of toluene insoluble components contained in the polymer composing the domain phase is from 30 to 70 mass %.

10. The electrostatic image developing toner of claim 1, wherein toluene insoluble components contained in the polymer composing the domain phase has a mass average molecular weight (Mw) of 20,000 to 1,500,000.

11. The electrostatic image developing toner of claim 1, wherein toluene insoluble components contained in the polymer composing the domain phase has a mass average molecular weight (Mw) of 40,000 to 800,000.

12. The electrostatic image developing toner of claim 1, wherein a content of the polymer composing the domain phase is 0.3 to 7.0 mass % based on a total mass of the polymer composing the matrix phase and the polymer composing the domain phase.

13. The electrostatic image developing toner of claim 1, wherein a content of the polymer composing the domain phase is 2.5 to 4.0 mass % based on a total mass of the polymer composing the matrix phase and the polymer composing the domain phase.

14. The electrostatic image developing toner of claim 1, wherein the styrene-acrylic resin is a random copolymer made of a styrene system monomer and an acrylic acid system monomer.

15. The electrostatic image developing toner of claim 1, wherein the glass transition temperature of the polymer composing the domain phase is −45 to +30° C.

* * * * *